United States Patent [19]

Harvey et al.

[11] Patent Number: 4,761,932

[45] Date of Patent: Aug. 9, 1988

[54] CAPSULE SEALING MACHINE

[75] Inventors: Larry L. Harvey, Lebanon; Ralph A. Volpe, Landisville, both of Pa.

[73] Assignee: Warner-Lambert Company, Morris Plains, N.J.

[21] Appl. No.: 14,840

[22] Filed: Feb. 13, 1987

[51] Int. Cl.[4] ..... B65B 51/02; B65B 51/20

[52] U.S. Cl. ..... 53/329; 53/900

[58] Field of Search ..... 53/900, 329, 77, 477; 198/389, 445, 446

[56] References Cited

U.S. PATENT DOCUMENTS

| | | | |
|---|---|---|---|
| 1,545,777 | 7/1925 | Kath et al. | 53/900 X |
| 2,466,936 | 4/1949 | Dowie et al. | 198/389 |
| 2,835,088 | 5/1958 | Eddison et al. | 53/77 |
| 2,858,930 | 11/1958 | Aidlin | 198/389 |
| 2,940,234 | 6/1960 | Greer | 53/329 X |
| 3,266,613 | 8/1966 | Grafius | 198/389 |
| 3,387,695 | 6/1968 | Hendrickson | 198/445 X |
| 3,538,677 | 11/1970 | Amoroso et al. | 53/329 X |
| 3,917,055 | 11/1975 | Vandenberg et al. | 198/389 X |
| 4,581,875 | 4/1986 | MacLaughlin et al. | 53/477 X |

*Primary Examiner*—Horace M. Culver

*Attorney, Agent, or Firm*—Howard Olevsky; Gary M. Nath

[57] ABSTRACT

A capsule sealing machine (10) in which capsules (C) are fed from a supply hopper (16) to a rotating sealing table (12) for banding or sealing the capsules as they pass over a set of sealing wheels (13). The sealing machine has an improved capsule guide (22) for feeding the capsules from the hopper to the table, thereby reducing the cost and complexity of the machine while at the same time enabling a greater number of capsules to be sealed or banded in a given amount of time and space. The capsule guide comprises slotted magazine sections (23, 28 and 30) which are caused to vibrate by a vibrator (48) to promote discharge of capsules from the hopper and to advance the capsules along the slots. In one form of the invention, a capsule orienting device (51) is disposed in alignment with the magazine to orient the capsules in a desired end-for-end relationship before they are discharged onto the table. An improved drive (59) for the capsule transport assembly (15) is also disclosed, in which the drive is automatically disengaged upon jamming or other malfunction in the transport to thereby prevent damage to the machine and/or other adverse consequences.

15 Claims, 7 Drawing Sheets

16
17
18, 19
20
22
23
24
26
27
28
29
30
34
35
36
37
38
39
40
41
47
48
49
50
12
69

30
31
33

10
11
31
33
β

29
28

23
24
25
26

28
29
8

11
15
59
60
61
62
63
64
65
66
67
68

CAPSULE SEALING MACHINE

TECHNICAL FIELD

This invention relates to capsule sealing or banding machines, and more particularly, to improved capsule guide and feed structure for supplying capsules to the sealing apparatus on such machines.

BACKGROUND ART

One manner of protecting gelatin capsules from tampering has been the placing of a gelatin band formed in situ around the juncture of a capsule cap and body after the capsule has been filled. U.S. patent application Ser. No. 869,748, filed June 2, 1986, by Harvey, et. al., discloses a liquid sealing process for joining gelatin capsule segments which can also be performed on machines used conventionally for capsule banding. This process involves the replacement of the fluid gelatin used for banding with a sealing fluid mixture comprising alcohol, e.g. ethanol and water, heated to a temperature of 40° C. to 60° C. The fluid is applied by contacting the juncture between cap and body with the solution from a reservoir positioned below the banding table by means, e.g., of a print wheel. As used herein, banding machine and banding are used interchangeably with "sealing machine" and "sealing" and the apparatus of this invention subsequently described is understood to refer to both processes.

In conventional banding machines, the capsules are fed from a supply hopper to a rotating banding table or product transport plate via a complex set of cams, levers and push rods. This capsule feed structure has a large number of moving parts, is difficult to adjust, prone to wear and difficult to maintain in proper adjustment. Moreover, any breakdown in the feed apparatus is time-consuming and expensive to repair, and the nature of the capsule feed structure limits the number of capsule banding stations or slots which can be provided on the banding table. For example, one typical prior art capsule banding machine in widespread use has only six tracks or banding slots in the banding table.

Further, in a conventional banding machine the capsules are conveyed by the banding table or product transport plate to a plurality of capsule-receiving outlet transport trays. These trays are typically chain driven via a direct drive connection with the power means for the machine. In the event of a jam or other malfunction in this product outlet conveying system, breakage of the transport system is likely to occur, with resultant spillage of the capsules being conveyed thereon and prolonged down time of the machine in order to make repairs.

DISCLOSURE OF THE INVENTION

In accordance with the present invention, an improved capsule feed structure is provided for feeding the capsules from the supply hopper to a table where a sealing operation such as banding can occur. As a result of the improved capsule feed structure, the capacity of this sealing table is also significantly increased, enabling a substantially greater number of capsules to be sealed in a given time and space than can be accomplished with a prior art machine. Moreover, an improved drive connection is provided between the motive power means and the product outlet transport group to prevent breakage or other damage in the event of a jam or other malfunction occurring in the outlet transport group.

The improved capsule feed structure of the invention comprises a slotted capsule guide or magazine positioned to receive capsules from the supply hopper and to discharge the capsules in a predetermined orientation onto the capsule sealing table. The magazine includes a first slotted capsule-receiving guide section disposed beneath an open bottom end of the hopper for receiving and aligning capsules in end-to-end relationship in the slots. A second slotted guide section is positioned to receive capsules from the first section and to convey them to a third slotted section which further orients the capsules and deposits them into pockets in the respective tracks of the banding table. A vibrator is connected with the magazine to promote discharge of the capsules from the hopper into the slots of the first section and to facilitate advancement of the capsules along the slots to the banding table.

In one form of the invention, a capsule rectifier or orienting device is associated with the slotted magazine to orient all of the capsules in a common end-to-end relationship prior to discharge of the capsules onto the sealing or banding table.

The unique slotted capsule guide of the invention is simple and economical in construction and operation and enables a nearly two-fold increase in the number of capsules which can be sealed on a capsule banding machine as compared with prior art devices. For example, a typical prior art capsule banding machine modified to incorporate the capsule guide assembly of the invention in place of the complex cam, lever and push rod assembly of the prior art can utilize a ten-track banding table. Moreover, the capsule-receiving pockets in the respective tracks can be placed more closely together in a circumferential direction.

Further, with the exception of the vibrator, there are no moving parts in the guide of the invention. Consequently, the initial cost of the guide is low in comparison with prior art devices, repair and replacement is easily accomplished, and adjustment is simple to effect.

According to another aspect of the invention, an improved drive connection is provided to the outlet product transport assembly in the banding machine, whereby the drive is disconnected in the event of an overload, as might occur, for example, if a capsule becomes jammed in the drive for the transport assembly. This prevents breakage or other damage in the transport assembly which could result in spillage of capsules and significant down time for the machine in order to make repairs. With the improved drive connection of the invention, the drive is disconnected upon the occurrence of an overload, and after correction of the cause of the overload the drive can be quickly and easily reset, enabling resumption of operation of the machine.

BRIEF DESCRIPTION OF THE DRAWINGS

Further objects, features and advantages of the invention will become apparent upon consideration of the following detailed description in conjunction with the drawings, in which like reference characters designate like parts throughout the several views, and wherein.

BEST MODE FOR CARRYING OUT THE INVENTION

Figure 1:
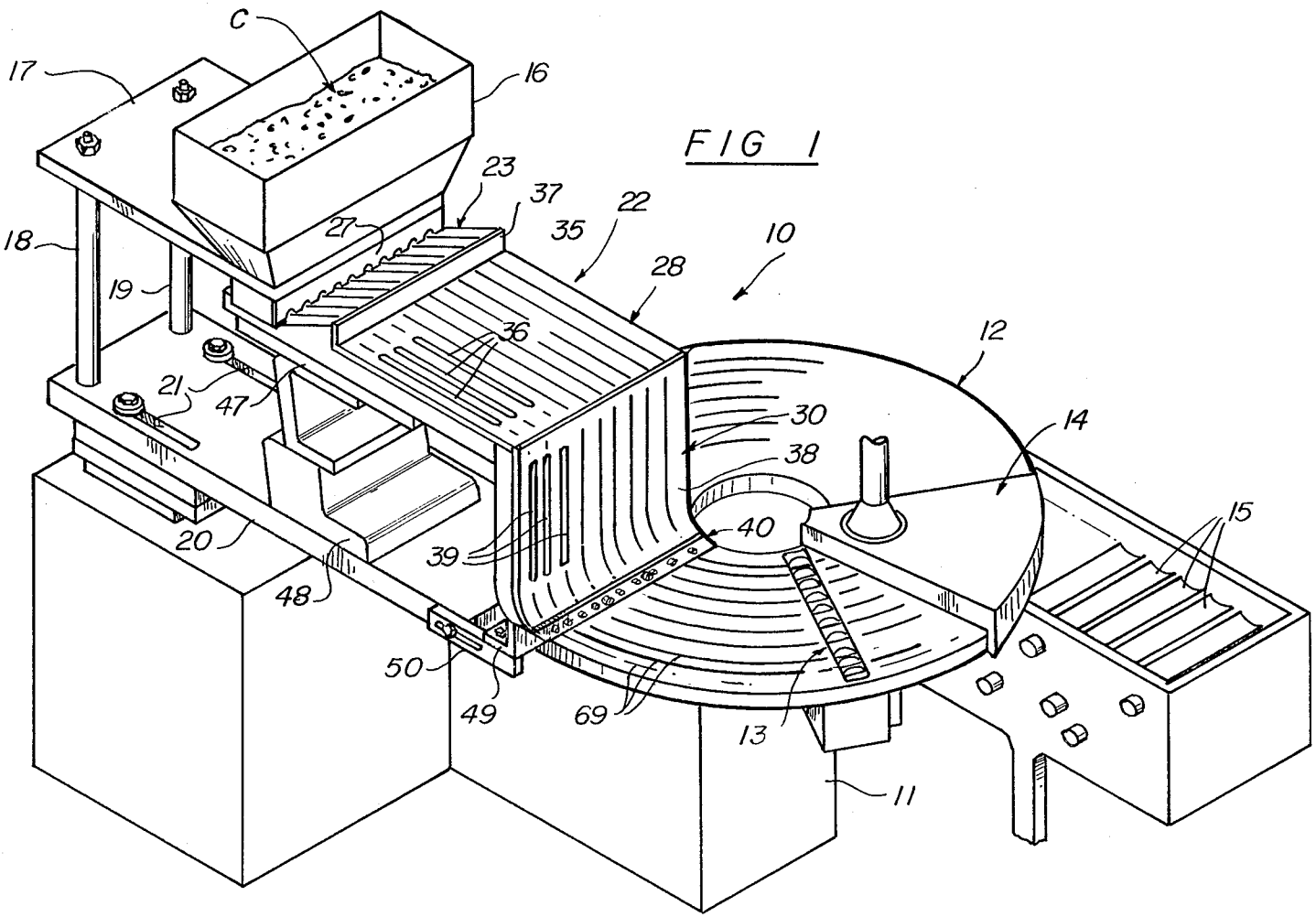
FIG. 1 is a top perspective view of a banding or sealing machine having the improved capsule feed and guide means of the invention thereon.

Referring more specifically to the drawings, a capsule banding or sealing machine is indicated generally at 10 in FIG. 1. The sealing machine comprises a housing 11 on which is supported a rotating product transport plate or sealing table 12 for moving capsules past a capsule sealing apparatus 13 and thence through a drying chamber defined by hood 14. The sealed capsules C are then discharged onto a plurality of outlet transport trays 15. Suitable motor means (not shown) and drive means (not shown) are supported in the housing for operating the sealing table and outlet transport trays.

Capsules C to be banded or sealed are placed in a hopper 16 supported above the machine at one end of a support plate 17. The support plate is attached at one end via a pair of upright stanchions 18 and 19 secured at their lower ends to one end of a mounting plate or base plate 20 supported on the housing 11. The other end of the base plate 20 extends into close proximity with the sealing table 12 and is oriented in a generally tangential direction relative thereto and is adjustable relative to the sealing table via the slotted connections 21.

Figures 2, 3, 4, 5:
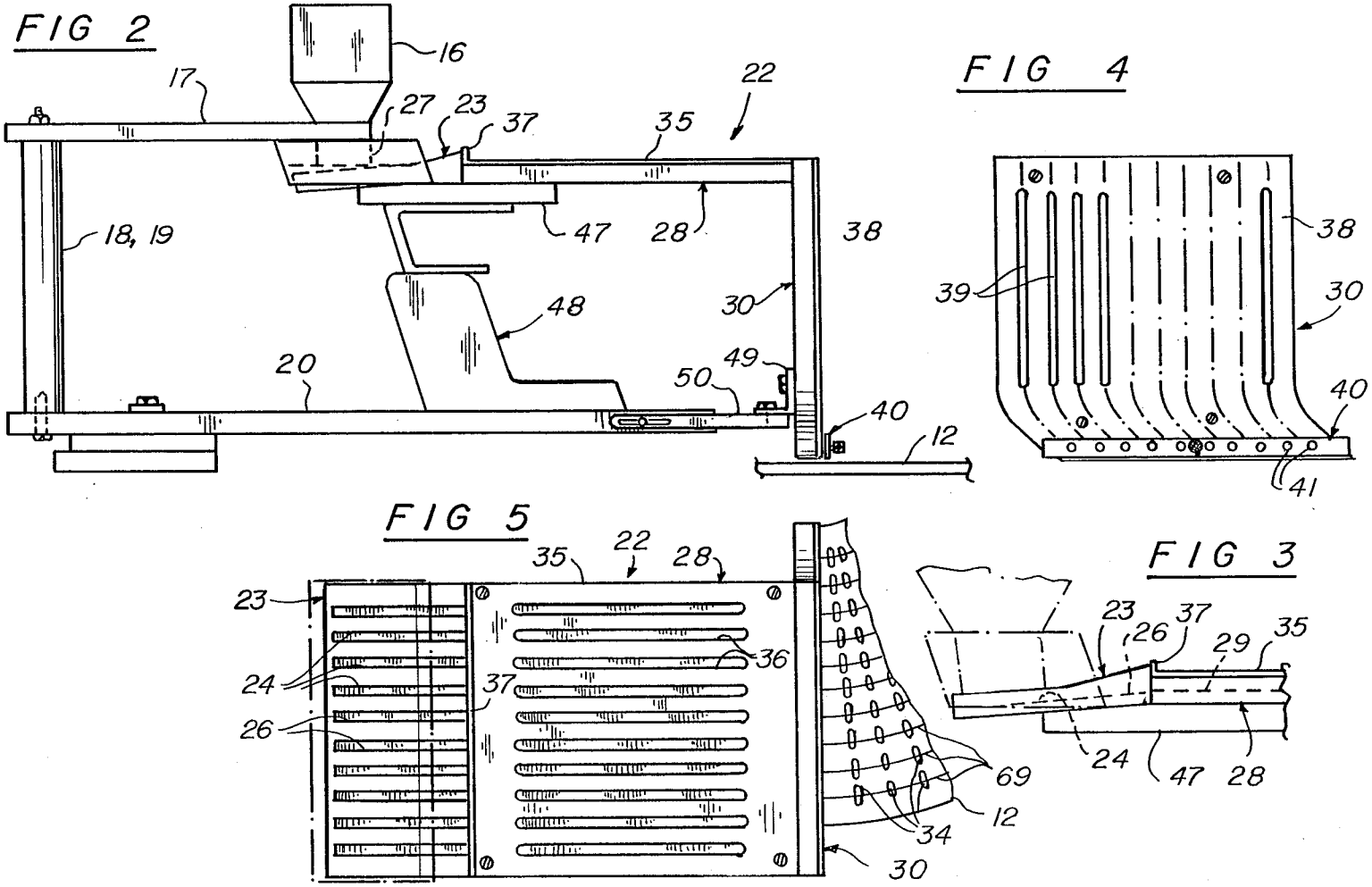
FIG. 2 is an enlarged, somewhat schematic side view in elevation of the capsule feed and guide means of the invention.
FIG. 3 is a further enlarged, fragmentary side view in elevation of the capsule feed and guide means.
FIG. 4 is an end view in elevation of a portion of the guide means.
FIG. 5 is a plan view of the guide means, showing a portion of the ten track banding table.

The improved capsule feed and guide means of the invention is referred to generally at 22 in FIG. 1 and is shown specifically in FIG. 5. The feed and guide means comprises a first guide section or magazine 23 disposed beneath the open bottom end of the hopper 16 for receiving capsules from the hopper and orienting them in endwise relationship in a plurality of slots 24 formed in the top surface of the magazine. The magazine section 23 has a back wall 25 closing one end of the slots 24 therein, whereby the capsules deposited in the slots can advance only in a forward direction. Further, the top surface of the magazine section 23 extends upwardly toward the discharge end thereof, defining a relatively deeply slotted portion 26. A notched gate or baffle 27 constrains the capsules to enter the slots 24 as the capsules leave the open bottom end of the hopper.

Figures 6, 7, 8, 9, 10, 11:
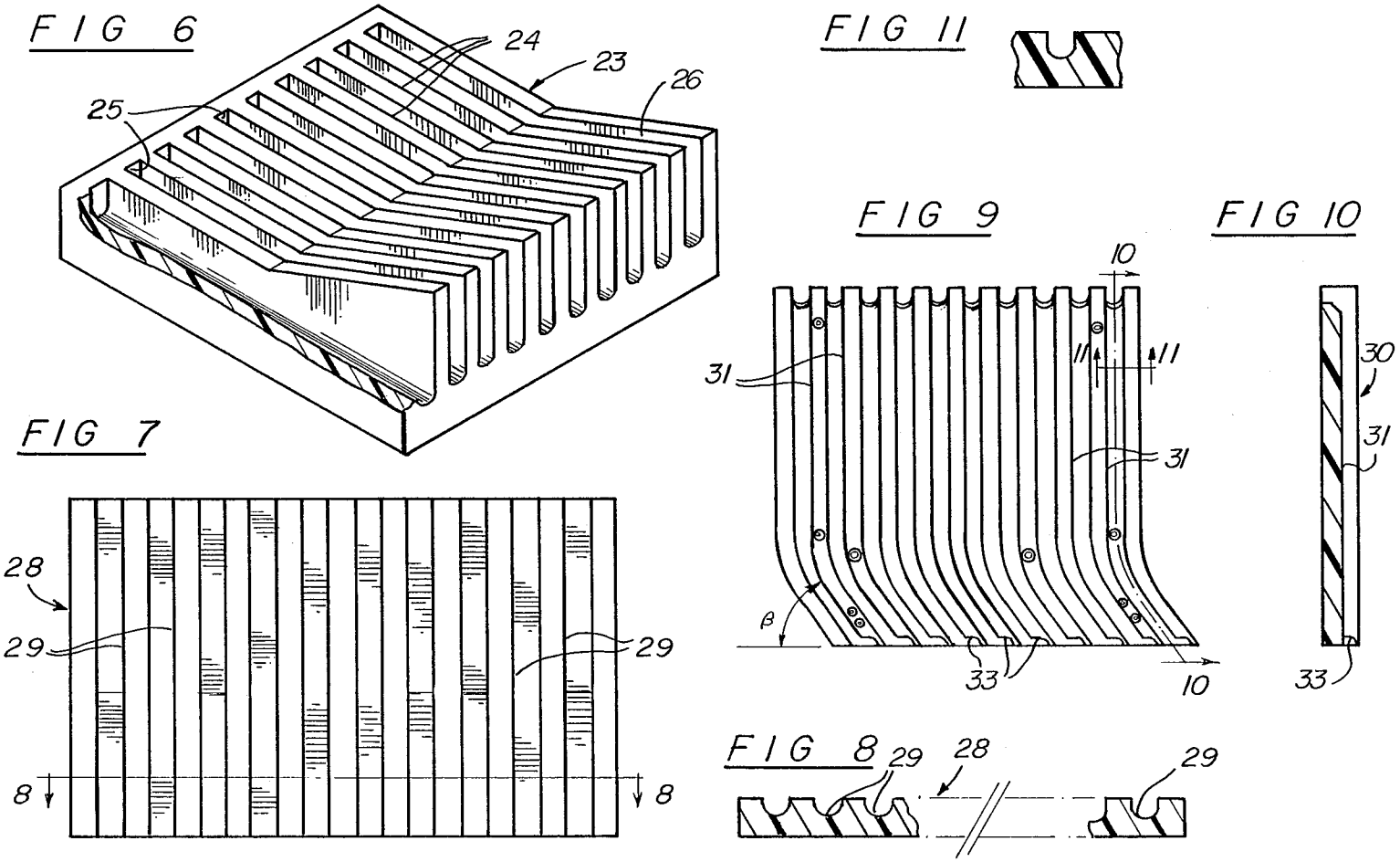
FIG. 6 is a greatly enlarged top perspective view of a first section of the capsule feed and guide means.
FIG. 7 is a plan view of a second section of the capsule feed and guide means.
FIG. 8 is a transverse sectional view taken along line 8—8 in FIG. 7.
FIG. 9 is a front view in elevation of a third section of the capsule feed and guide means.
FIG. 10 is a sectional view taken along line 10—10 in FIG. 9.
FIG. 11 is a fragmentary transverse sectional view taken along line 11—11 in FIG. 9.

Referring to FIGS. 6 and 7, a second, generally horizontally disposed, substantially rectangularly shaped guide section or magazine 28 is disposed in alignment with the first section 23 and has a plurality of slots 29 formed in the upper surface thereof for receiving the capsules from the first section. The capsules are advanced one-by-one in endwise, substantially contiguous relationship in each of the slots 29 to the upper end of a generally vertically disposed third guide section or magazine 30 having slots 31 formed therein to receive the capsules from the slots 29. As seen best in FIGS. 9 and 10, the upper edge of the back wall of slots 31 is beveled at 32 to provide clearance for turning or pivoting of the capsules from a horizontal to a vertical position as they enter the slots 31.

Referring once more to FIG. 9, the lower end of the third section is displaced laterally so that the lower ends of the slots 31 therein are angularly disposed relative to the plane of the table 12. In the specific construction shown, the slots subtend an angle $\beta$ of about 40° with the plane of the table. In addition, the bottom-most end of each slot 31 is cut out or enlarged at the side thereof which defines an obtuse angle with the plane of the table 12. This cut out or enlarged area 33 defines a space into which each capsule moves as it reaches the bottom end of the slot, whereby the capsules assume a horizontal position with their longitudinal axes arranged parallel to the planes of the table 12 and the third section or magazine 30. Thus, with reference to FIG. 5, the capsules are properly oriented and deposited into the capsule-receiving pockets 34 formed in the sealing table 12.

It should be noted that the slots in the magazine sections have a rounded or curved bottom conforming to the cross-sectional shape of the capsules, and have a width and depth slightly greater than the cross-sectional dimension of the capsules.

A cover plate 35 is secured over the top of the second guide section or magazine 28 in overlying relationship to the slots 29 therein for confining the capsules to the slots. The cover plate 35 is preferably transparent and has slots 36 therein extending in alignment with the slots 29 in the magazine 28 whereby an implement may be inserted through the slots 36 to engage and free any capsule which may become lodged in its slot 29. The forward edge of the cover plate is turned upwardly to define a flange 37 which abuts against the discharge end of the first magazine section 23 to limit the size of the discharge opening from the slots 24 to an area corresponding to the entry into the slots 29 in the second magazine section 28.

A cover plate 38 also is secured over the third magazine section 30 to confine the capsules to the slots 31. This cover is also preferably transparent and has slots 39 therein extending in registry with the slots 31 in the magazine 30, whereby any capsule which becomes lodged in its slot can be freed by inserting an implement through the slot 39. Additionally, as seen best in FIGS. 13 and 14, the lower edge of cover plate 38 is notched at locations corresponding to the discharge ends of the slots 31 to provide clearance for the horizontally disposed capsules resting in the pockets 34 of the table 12.

Figures 12, 13, 14, 15, 16, 17:
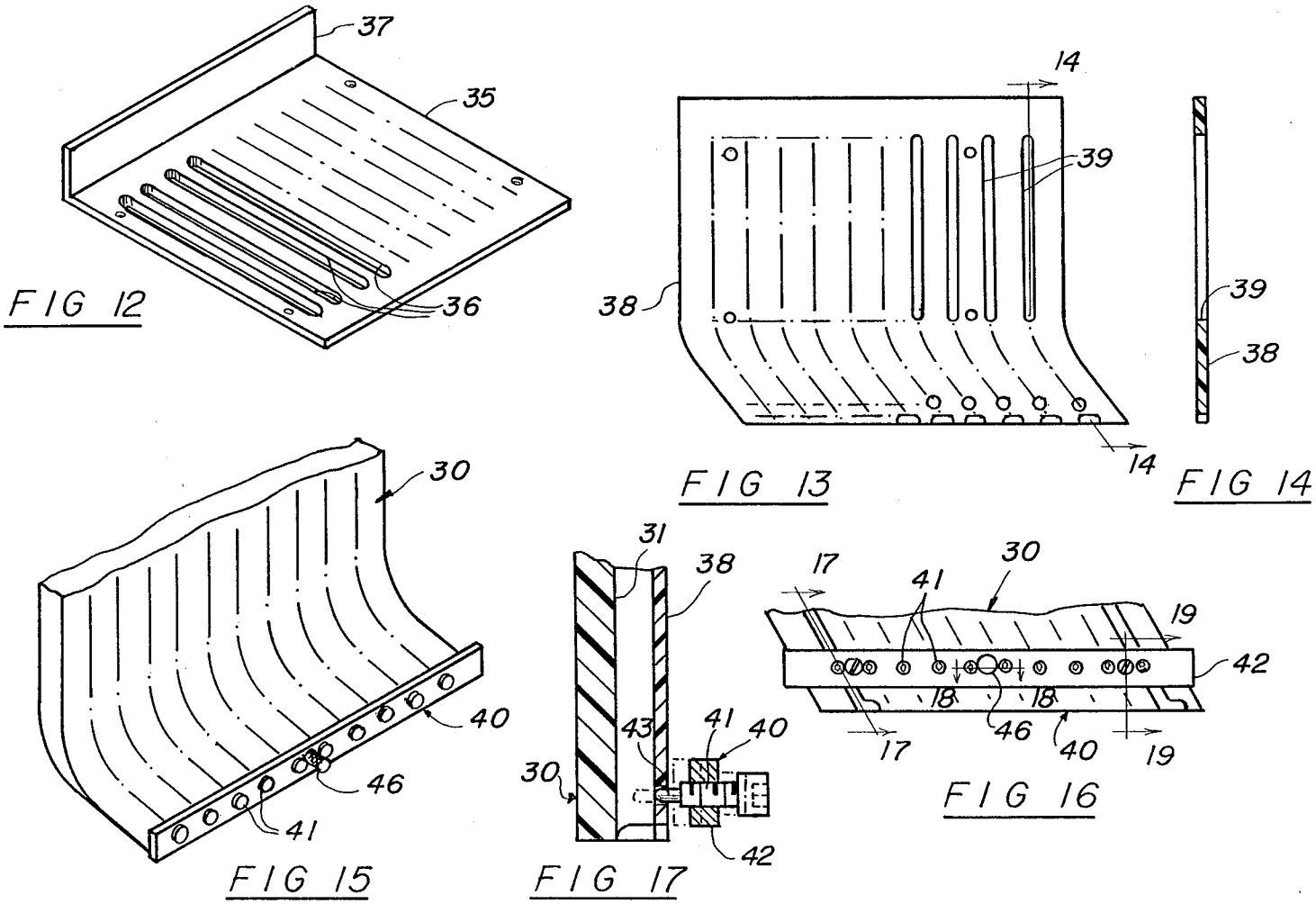
FIG. 12 is a top perspective view of a cover plate for covering the second section of the guide means.
FIG. 13 is a front view in elevation of a cover plate for covering the third section of the guide means.
FIG. 14 is a sectional view taken along line 14—14 in FIG. 13.
FIG. 15 is a fragmentary front perspective view of a lower end portion of the second capsule feed and guide section, showing a selectively operable stop means for preventing discharge of capsules from the slots of the guide means.
FIG. 16 is an enlarged fragmentary front view in elevation of a portion of the second section of the guide means, showing the stop means in greater detail.
FIG. 17 is a further enlarged, fragmentary view in section taken along line 17—17 in FIG. 16.
Figure 18:
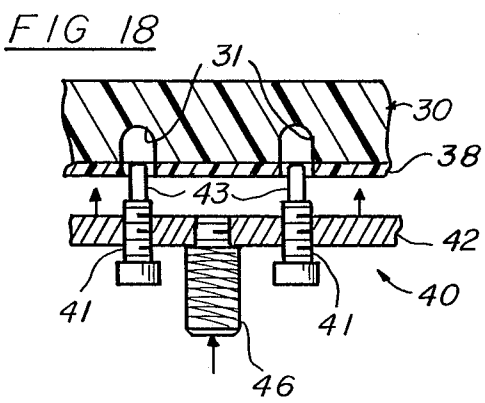
FIG. 18 is an enlarged fragmentary view in section taken along line 18—18 in FIG. 16.
Figure 19:
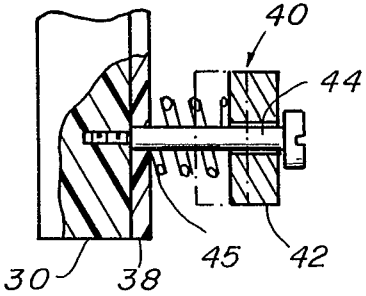
FIG. 19 is an enlarged fragmentary view in section taken along line 19—19 in FIG. 16.
Figure 20:
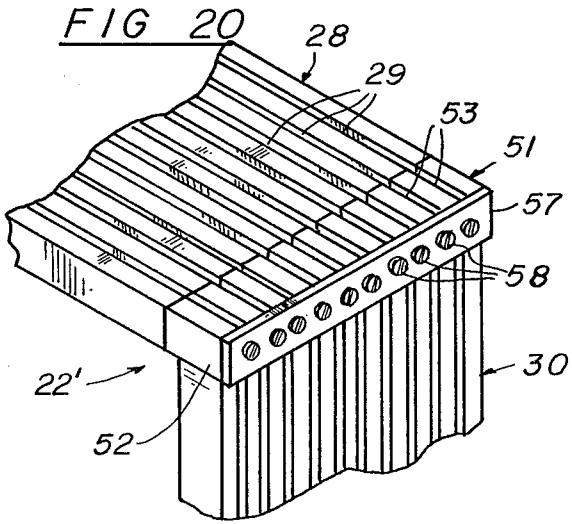
FIG. 20 is a fragmentary perspective view showing a portion of the second and third sections of the capsule feed and guide means, with a capsule orienting device interposed therebetween.
Figure 21:
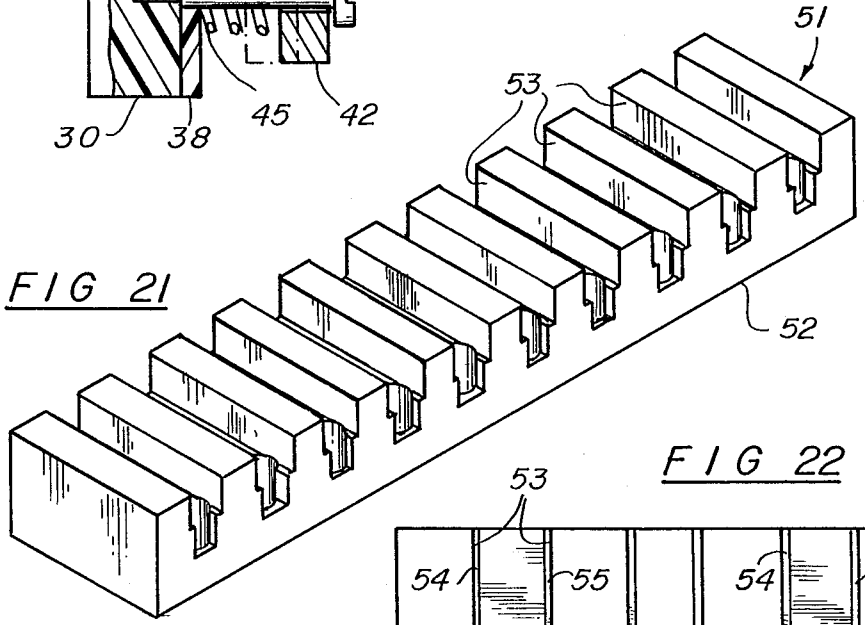
FIG. 21 is an enlarged perspective view of the capsule orienting device of FIG. 20.
Figure 22:
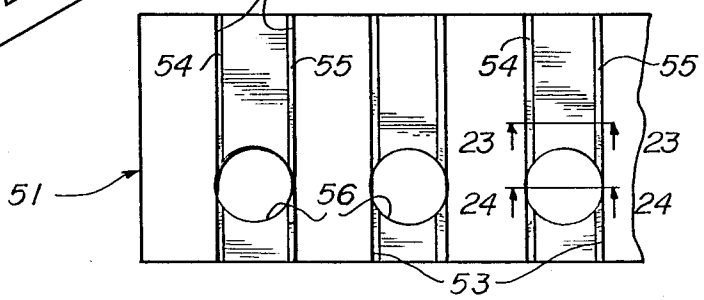
FIG. 22 is a further enlarged, fragmentary plan view of the capsule orienting device.

A spring loaded stop or gate assembly 40 is mounted to the bottom end of the third magazine section 30 and has a plurality of adjustable stop pins 41 carried by an elongate bar 42. The pins 41 have an end portion 43 which normally is positioned in an aligned opening in the cover plate 38, clear of the slots 31 (FIG. 17). However, as seen in FIG. 19, the bar 42 is slidably positioned on a plurality of guide screws 44 and is spring-biased outwardly away from the magazine section 30 by springs 45 to the position shown in FIGS. 17 and 18. By grasping handle 46, the bar 42 may be pressed inwardly toward the magazine 30 against the bias of the springs 45, causing the pins 43 to move into the slots 31, blocking movement of the capsules through the slots 31. This gate may be used to prevent discharge of capsules from the magazine 22 at any time desired by the operator of the machine. For instance, when the sealing machine is first started up, the gate may be used to prevent discharge of capsules onto the sealing table 12 until all of the slots in the magazine are full, thus insuring that the machine will operate at full capacity.

The entire magazine assembly 22, including the first, second and third sections, is mounted via a base plate 47 to a vibrator 48 for imparting a low amplitude, high frequency vibration to the magazine assembly. This vibratory motion promotes discharge of capsules from the hopper into the slots 24 of the first magazine section 23 and also causes movement of the capsules along the slots. As seen in FIG. 2, the vibrator 48 is connected to the magazine 22 near the inlet end thereof, and the bottom end of magazine section 30 is supported by brackets 49 carried on adjustable arms 50 connected to the forward end of base plate 20.

Figure 25:
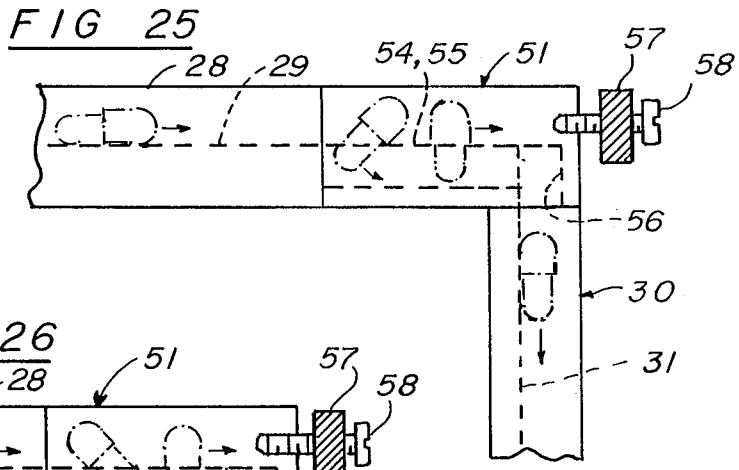
FIG. 25 is a schematic fragmentary view of a portion of the second and third sections of the capsule feed and guide means, showing how a capsule moving with its cap end trailing is caused to be oriented with the cap end disposed upwardly.
Figure 26:
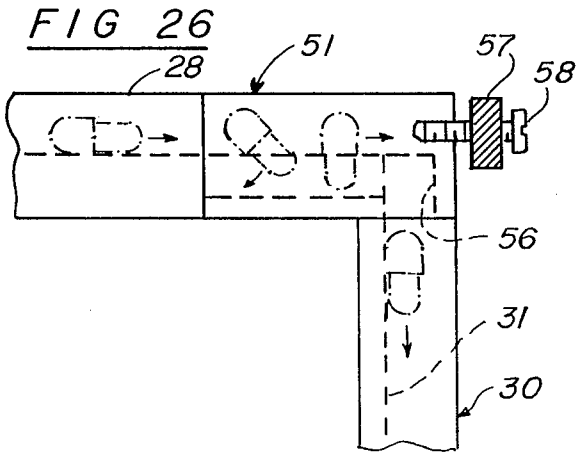
FIG. 26 is a view similar to FIG. 25, showing how a capsule moving with its cap end leading is caused to be oriented with the cap end disposed upwardly.
Figure 23:
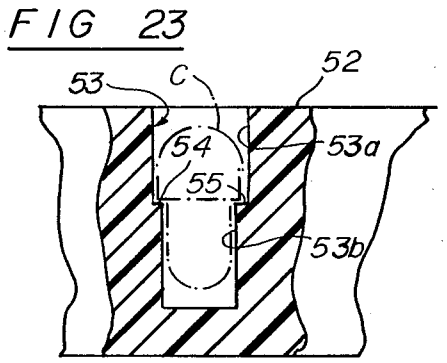
FIG. 23 is an enlarged fragmentary sectional view taken along line 23—23 in FIG. 22, showing in dot-and-dash lines how a capsule is supported by its cap on the shoulders in the slotted orienting device.
Figure 24:
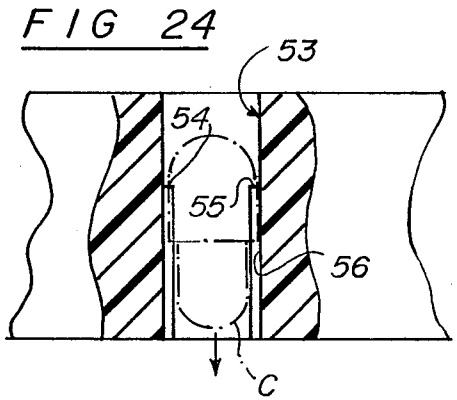
FIG. 24 is a view similar to FIG. 23, but taken along line 24—24, showing how the capsule is permitted to fall when it reaches the interruption in the shoulders.

In the apparatus thus far described, the capsules are not oriented in any particular end-to-end relationship; i.e., either the cap or the body end may be oriented first as the capsules advance through the slots and are deposited into the pockets 34 in the table 12. However, as illustrated in FIGS. 20 through 24, a capsule rectifier or orienting bar 51 may be provided in association with the magazine 22' for orienting all of the capsules in the same end-for-end relationship. That is, after the capsules pass through the orienting bar, they will all have the cap end trailing in the particular construction shown. The orienting bar 51 merely comprises an elongate bar 52 having a plurality of slots 53 formed therein in registry with the slots 29 in the second magazine section 28. A pair of upwardly facing shoulders or tracks 54 and 55 are formed on the sidewalls of each slot 53, extending throughout the length of the slot, and dividing the slot into an upper portion 53A having a width slightly greater than the cross-sectional width of the cap of a capsule and a lower portion 53B having a width slightly less than the cross-sectional dimension or width of the cap end of the capsule. Thus, as a capsule moves along a slot 53, the cap end thereof will be supported on the shoulders, while the body of the cap drops into the lower section of the slot. Consequently, as seen in Figures 25 and 26, all capsules moving through the rectifier 51 will be oriented with their cap ends up. A circular opening or hole 56 having a diameter slightly greater than the diameter of the cap end of the capsule is formed through the bar in each slot and these holes are aligned with the slots 31 in the third magazine section 30. Therefore, as each capsule reaches its corresponding opening 56, it will drop into the respective slot 31 and will be oriented with its cap end up so that when the capsule is deposited into the pocket 34 in the table 12, all of the capsules will be oriented in the same direction. A bar 57 carrying a plurality of adjustable stops 58 is attached to the rectifier so that the stops 58 extend into the discharge end of the slot to limit travel of the capsule to a position corresponding with the location of the hole 56.

Figures 27, 28, 29, 30:
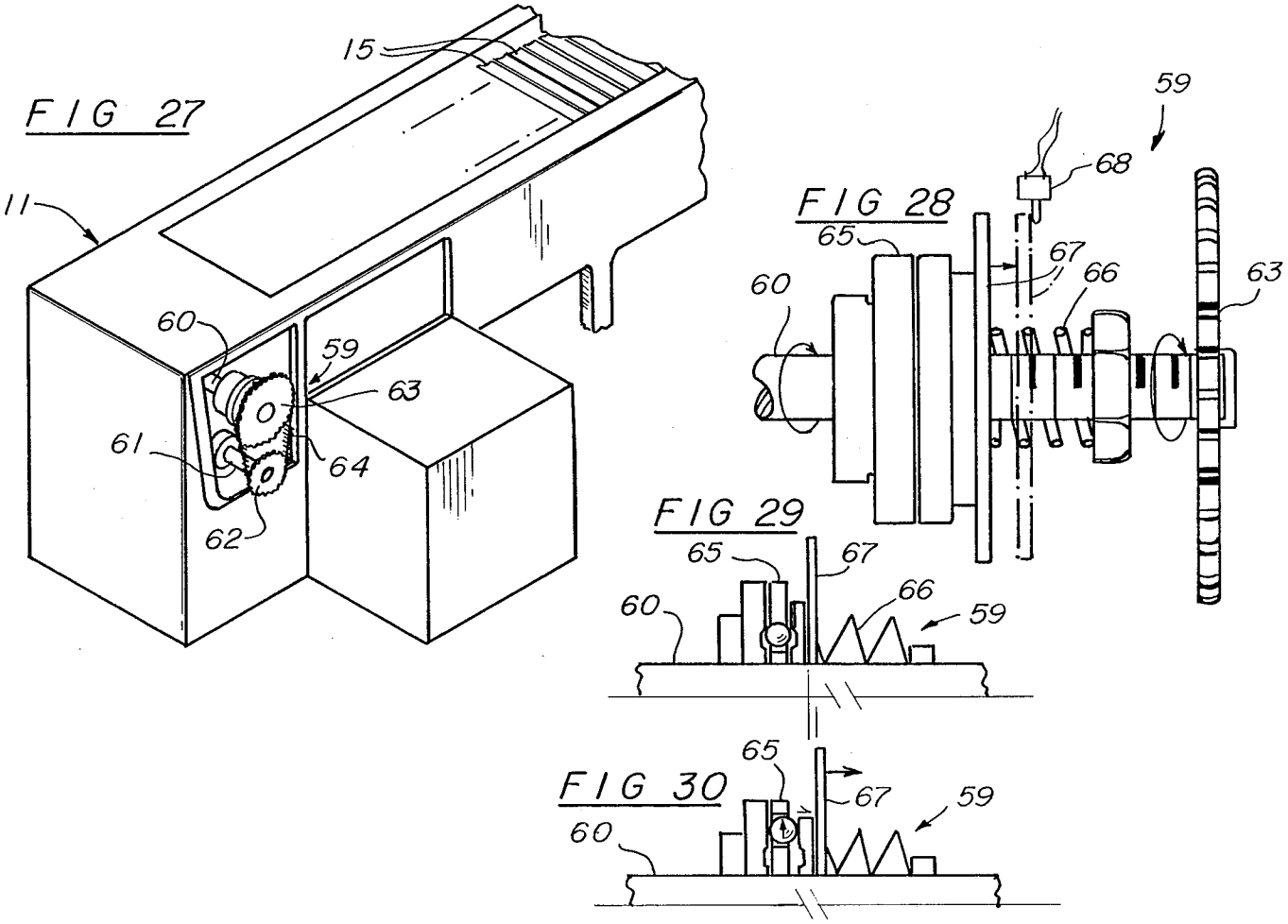
FIG. 27 is a fragmentary, somewhat schematic perspective view of a portion of the cabinet of a capsule banding machine, showing the improved drive connection incorporated therein.
FIG. 28 is an enlarged plan view of a portion of the drive means, with the improved drive connection or torque overload disconnect device interposed between the drive shaft and driven shaft.
FIG. 29 is a fragmentary, schematic sectional view of the overload disconnect device in its normal, engaged condition.
FIG. 30 is a view similar to FIG. 29, showing the overload disconnect device in its disengaged condition.

Further, as illustrated in FIGS. 27 through 30, a torque overload device 59 may be interposed in the drive connection between the source of motive power (not illustrated) and the driven shaft 60 for the capsule outlet transport assembly or trays 15. More particularly, a drive shaft 61 and drive sprocket 62, connected with the source of power, are connected with a driven sprocket 63 via chain 64. The driven sprocket 63, in turn, is connected through the torque overload device 59 to the driven shaft 60. Therefore, if something occurs to impede movement of the outlet transport assembly trays, e.g., jamming of a capsule in the drive chain for the trays, the torque overload device will function to disconnect the drive from the transport assembly, preventing damage to components of the machine and/or spillage of capsules carried on the trays 15. As illustrated in FIGS. 28 through 30, the torque overload device 59 includes a ball detent drive connection 65 which is held in engaged position by an adjustable spring 66. When the torque limit, as set by the spring 66, is reached the balls will immediately move into their disengaged position as shown in FIG. 30, disconnecting the drive from the driven shaft 60. At the same time, plate 67 is caused to move to the right, contacting limit switch 68 and interrupting power to the power source. Thus, the machine is automatically turned off in the event of an overload. The operator can then locate the source of trouble and after the problem is corrected the drive connection is quickly and easily reset, the machine turned on and operation resumed.

The simple and effective capsule feed and guide means as described herein for the improved sealing or banding machine is not only much less expensive than prior devices, it is also more reliable and easier to service, and, perhaps most importantly, it enables ten tracks 69 to be provided in the sealing table 12 as compared with the six tracks customary in a conventional machine. Moreover, the capsule-receiving pockets 34 in the tracks 69 can be spaced more closely together in a circumferential direction than can prior art devices. Further, the drive disconnect or torque overload device described herein prevents costly damage and downtime to the machine.

The slotted magazines and cover plates used in the invention may be made of any suitable material, including plastic, and may be provided in different sizes for different capsules.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

We claim:

1. In a capsule sealing machine having a supply source for capsules to be sealed, a horizontally disposed rotating capsule transport plate or sealing table with a plurality of elongate, spaced apart capsule-receiving pockets in a stop surface thereof for receiving and supporting capsules therein, said pockets being oriented with their respective longitudinal axes parallel to the plane of the table whereby the capsules are supported on their side, capsule feed and guide means for guiding and conveying capsules from the source to the table, and means associated with the table for sealing capsules carried in the pockets, the improvement comprising:

said capsule feed and guide means having means for guiding and conveying capsules from the source to the table and depositing the capsules on their side into the pockets in the table, said guide means comprising a first substantially horizontally disposed plate means having a plurality of elongate, parallel guide slots in the upper surface thereof and having an inlet end and an outlet end; and a second plate means having a plurality of elongate, parallel guide slots therein and having an inlet end and an outlet end, said inlet end being positioned to receive capsules from the outlet end of the first plate means, and the outlet end of the second plate means being disposed adjacent said table and being configured and arranged to deposit said capsules on their side in said pockets.

2. A capsule sealing machine as claimed in claim 1, wherein:

said slots have a shaped cross-sectional configuration to support and guide the capsules in end-to-end relationship in the slots.

3. A capsule sealing machine as claimed in claim 2, wherein:

the capsule supply source is above the table, and the capsules are moved along the guide slots under the influence of gravity.

4. A capsule sealing machine as claimed in claim 3, wherein:

vibrator means is connected with at least one of the slotted plate means to vibrate the plate means and facilitate advancement of the capsules along the slots from the supply source to the table.

5. A capsule sealing machine as claimed in claim 4, wherein:

said first plate means includes first and second substasntailly rectangularly shaped, generally horizontally disposed, plate-like sections each having an inlet end and an outlet end and a plurality of parallel slots formed in the top surfaces thereof extending from the respective inlet end to the respective outlet end, said first section positioned to receive capsules from the supply source and for aligning and advancing the capsules in end-to-end relationship across the first section; and said second section is positioned in end-to-end aligned realtionship with the first section for receiving the capsules from the first section and guiding them in end-to-end relationsip across the second section.

6. A capsule sealing machine as claimed in claim 5, wherein:

said second plate means includes a plate-like third section lying in a plane angularly disposed relative to the plane of the table, said slots in the third section extending from the inlet end to the outlet end thereof, said inlet end being in aligned registry with the outlet end of the second section, and the outlet end of the third section is adjacent the table.

7. A capsule sealing machine as claimed in claim 6, wherein:

the third section lies in a plane parallel to a radius of the sealing table, and the axes of the outlet end portions of the slots in the third section are displaced in the plane of the third section from the axes of the inlet portions thereof, so that capsules guided by the slots are discharged onto the table with the longitudinal axes of the capsules disposed substantially parallel both to the plane of the table and to a radius thereof.

8. A capsule sealing machine as claimed in claim 7, wherein:

cover plates are secured over the slots in the second and third sections to confine the capsules to the slots.

9. A capsule sealing machine as claimed in claim 8, wherein:

the cover plates are slotted in alignment with the slots in the respective magazine sections to enable an implement to be inserted through the slots in the cover plates to free a lodged capsule in the magazine slot.

10. A capsule sealing machine as claimed in claim 9, wherein:

a capsule orienting device having means for orienting all of the capsules in the same end-for-end direction is associated with the slotted magazine so that all capsules guided by the magazine pass therethrough.

11. A capsule sealing machine as claimed in claim 10, wherein:

a selectively operable capsule stop assembly is associated with the outlet end of the magazine for blocking discharge of capsules from the magazine when the stop assembly is moved to a blocking position by an operator of the machine.

12. A capsule sealing machine as claimed in claim 11, wherein:

the plate means is made of thermoplastic material, and the cover plates are transparent.

13. A capsule sealing machine as claimed in claim 1, wherein:

said pockets are oriented with their longitudinal axes parallel to a radius of the table.

14. In a capsule sealing machine having a supply source for capsules to be sealed, said capsules having a body portion and a cap with a greater diameter than the body, a rotating capsule transport plate or sealing table, means associated with the table for sealing capsules carried thereby, and capsule guide means extending between the supply source and the table for conveying and guiding capsules from the source to the table, the improvement comprising:

a capsule orienting device associated with the guide means so that all capsules conveyed by the guide means must pass through the orienting device, said orienting device comprising an elongate bar having a plurality of shaped slots extending transversely across an upper surface thereof, said shaped slots being defined by opposed side walls each having an upwardly facing shoulder formed thereon between a top and bottom of the respective wall, the dimensional relationship of the shoulders, side walls and capsule cap being such that the cap is supported on the shoulders while the body portion of a capsule is suspended between the side walls, thereby automatically orienting a capsule in a cap-end-up relationship.

15. A capsule orienting device as claimed in claim 14, wherein:

the orienting device has a hole at one end of each slot, the holes each having a diameter greater than the diameter of the cap of the capsule, and having its axis extending substantially perpendicular to the axis of the slot, whereby a capsule resting with its cap end on the shoulders will fall through the hole when the capsule is moved into alignment with the hole.

* * * * *